US009366989B2

(12) United States Patent
Ito et al.

(10) Patent No.: US 9,366,989 B2
(45) Date of Patent: Jun. 14, 2016

(54) IMAGE FORMING APPARATUS

(71) Applicants: Daisuke Ito, Kanagawa (JP); Ken Yoshida, Kanagawa (JP); Keiko Matsumoto, Kanagawa (JP); Yoichi Sakurai, Kanagawa (JP); Daisuke Takahashi, Kanagawa (JP)

(72) Inventors: Daisuke Ito, Kanagawa (JP); Ken Yoshida, Kanagawa (JP); Keiko Matsumoto, Kanagawa (JP); Yoichi Sakurai, Kanagawa (JP); Daisuke Takahashi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/589,955

(22) Filed: Jan. 5, 2015

(65) Prior Publication Data

US 2015/0192879 A1 Jul. 9, 2015

(30) Foreign Application Priority Data

Jan. 6, 2014 (JP) ..... 2014-000149

(51) Int. Cl.
*G03G 15/01* (2006.01)
*G03G 15/08* (2006.01)

(52) U.S. Cl.
CPC ..... *G03G 15/0822* (2013.01); *G03G 15/0121* (2013.01); *G03G 15/0126* (2013.01); *G03G 15/0142* (2013.01); *G03G 15/0189* (2013.01); *G03G 2215/0607* (2013.01)

(58) Field of Classification Search
CPC ..... G03G 15/06; G03G 15/0121; G03G 15/0189; G03G 2215/0607
USPC ..... 399/223
See application file for complete search history.

(56) References Cited

U.S. PATENT DOCUMENTS

| | | | | |
|---|---|---|---|---|
| 2005/0238391 | A1* | 10/2005 | Hibino | 399/267 |
| 2007/0280742 | A1 | 12/2007 | Matsumoto et al. | |
| 2008/0063434 | A1 | 3/2008 | Uno et al. | |
| 2008/0181630 | A1 | 7/2008 | Matsumoto et al. | |
| 2008/0279592 | A1 | 11/2008 | Matsumoto et al. | |
| 2009/0016784 | A1 | 1/2009 | Yoshida | |
| 2009/0103935 | A1 | 4/2009 | Uno et al. | |

(Continued)

FOREIGN PATENT DOCUMENTS

| | | |
|---|---|---|
| JP | 2004029306 | 1/2004 |
| JP | 2010-085958 | 4/2010 |
| JP | 2010286668 | 12/2010 |

OTHER PUBLICATIONS

European Communication for EP patent application 14199917.7, the extended European Search report dated May 19, 2015.

*Primary Examiner* — David Bolduc
*Assistant Examiner* — Barnabas Fekete
(74) *Attorney, Agent, or Firm* — Duft Bornsen & Fettig LLP

(57) ABSTRACT

An image forming apparatus includes at least one image bearer; multiple developing devices to develop the latent images with developers including toner and carrier into a toner image; multiple developer supply devices to supply the developers to the multiple developing devices, respectively; and a fixing device to fix the toner image on a sheet of recording media. When one of the multiple developing devices positioned at a shortest distance from an outline of the fixing device is referred to as a first developing device, and one of the multiple developer supply devices that supplies developer to the first developing device is referred to as a first developer supply device, the first developer supply device is greater in percentage by weight of carrier in developer supplied to the first developing device than rest of the multiple developer supply devices.

15 Claims, 3 Drawing Sheets

(56) References Cited

U.S. PATENT DOCUMENTS

2009/0110425 A1 4/2009 Uno et al.
2009/0196661 A1 8/2009 Yoshida
2011/0194863 A1 8/2011 Matsumoto et al.
2012/0163870 A1* 6/2012 Tamaki ..... 399/223
2013/0101303 A1 4/2013 Kasai et al.
2013/0156466 A1 6/2013 Bisaiji et al.

* cited by examiner

IMAGE FORMING APPARATUS

CROSS-REFERENCE TO RELATED APPLICATIONS

This patent application is based on and claims priority pursuant to 35 U.S.C. §119(a) to Japanese Patent Application No. 2014-000149, filed on Jan. 6, 2014, in the Japan Patent Office, the entire disclosure of which is hereby incorporated by reference herein.

BACKGROUND

1. Technical Field

Embodiments of the present invention generally relates to an electrophotographic image forming apparatus such as a copier, a facsimile machine, a printer, or a multifunction peripheral (MFP, i.e., a multifunction machine) having at least two of copying, printing, facsimile transmission, plotting, and scanning capabilities and, more particularly, to an image forming apparatus including multiple developing devices.

2. Description of the Related Art

In typical tandem image forming apparatuses such as copiers, facsimile machines, printers, and MFPs, multiple developing devices corresponding to different colors (e.g., black, yellow, magenta, and cyan) are arranged to face an intermediate transfer belt. There are developing devices that employ two-component developer including toner and carrier to develop latent images on image bearers such as photoconductor drums. Toner and carrier are may be supplied from separate containers. Alternatively, toner and carrier are premixed and contained in a common container.

Premix developing, in which degraded carrier is discharged from the developing device, is advantageous in that speed of degradation of carrier in the developing device is retarded, and replacement cycle of developer is elongated.

SUMMARY

An embodiment of the present invention provides an image forming apparatus that includes at least one image bearer to bear a latent image, multiple developing devices to develop the latent image with developers including toner and carrier into a toner image, multiple developer supply devices to supply the developers to the multiple developing devices, respectively, and a fixing device to fix the toner image on a sheet of recording media. When one of the multiple developing devices positioned at a shortest distance from an outline of the fixing device is referred to as a first developing device, the developer supplied to the first developing device by a corresponding one of the multiple developer supply devices is greater in percentage by weight of carrier than the developers supplied to rest of the multiple developing devices.

In another embodiment, an image forming apparatus includes at least one image bearer to bear a latent image, multiple developing means for developing the latent image with developers including toner and carrier into a toner image, multiple developer supplying means for supplying the developers to the multiple developing means, respectively, and a means for fixing the toner image on a sheet of recording media. When one of the multiple developing means positioned at a shortest distance from an outline of the means for fixing is referred to as a first developing means, the developer supplied to the first developing means by a corresponding one of the multiple developer supplying means is greater in percentage by weight of carrier than the developers supplied to rest of the multiple developing means.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
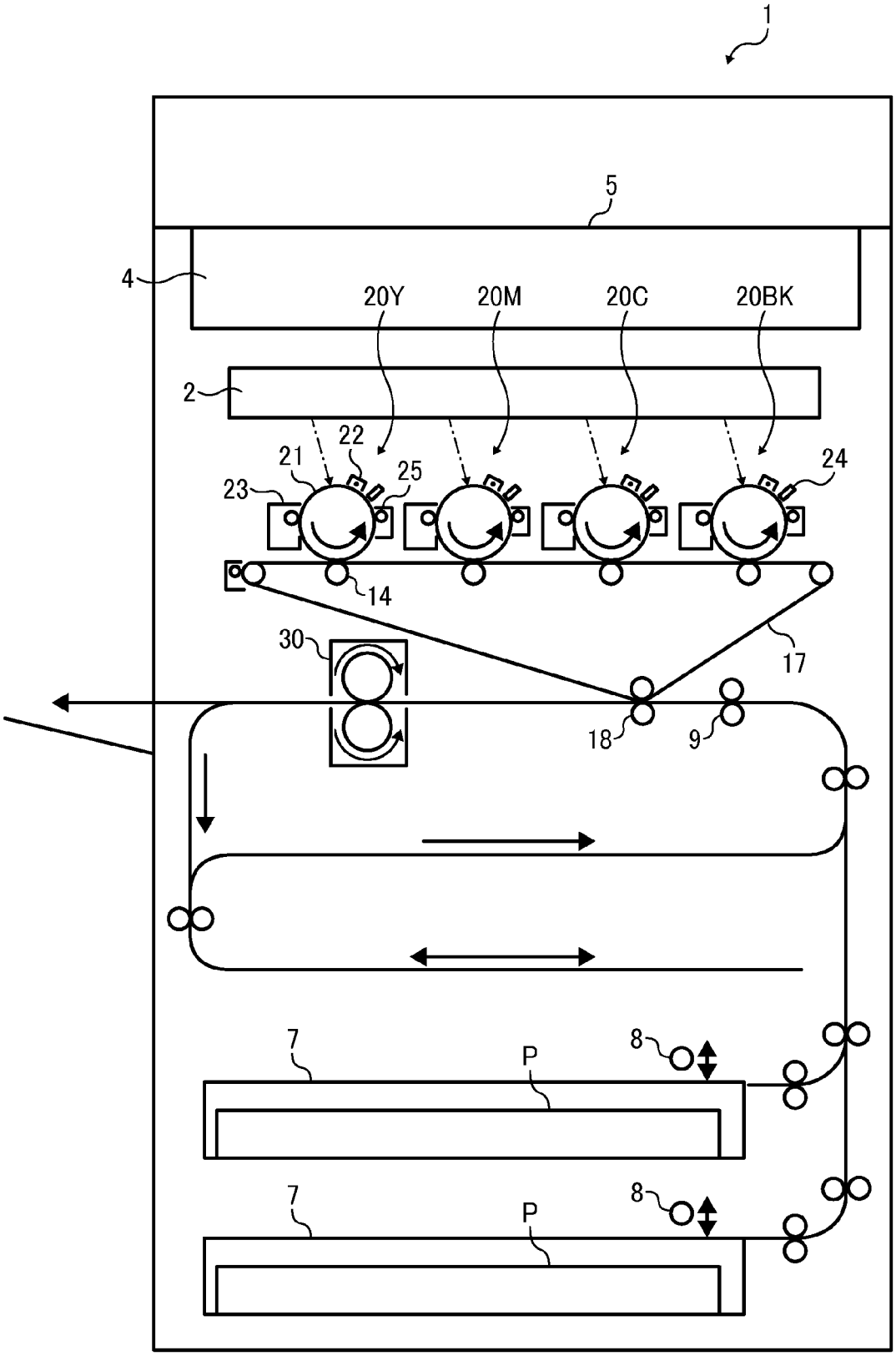
FIG. 1 is a schematic diagram illustrating a configuration of an image forming apparatus according to an embodiment.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a multicolor image forming apparatus according to an embodiment of the present invention is described.

It is to be understood that an identical or similar reference character is given to identical or corresponding parts throughout the drawings, and redundant descriptions are omitted or simplified below.

FIG. 1 is a schematic view of an image forming apparatus 1 according to an embodiment.

In FIG. 1, reference numerals 2 represents a writing unit to emit laser beams according to image data, 4 represents a document reading unit 4 that reads image data of an original (i.e., an original document) placed on an exposure glass 5, 7 represents a sheet feeding tray containing sheets P of recording media, 9 represents a pair of registration rollers to adjust the timing to transport the sheet P, 17 represents an intermediate transfer belt onto which multiple single-color toner images are transferred and superimposed, 18 represents a secondary-transfer roller to transfer the multiple single-color toner images from the intermediate transfer belt 17 to the sheet P, 20Y, 20M, 20C, and 20BK represent process cartridges (image forming units) corresponding to the respective colors, 21 represents a photoconductor drum serving as an image bearer of each of the process cartridges 20Y, 20M, 20C, and 20BK, 22 represents a charging device to charge a surface of the photoconductor drum 21, 23 represents a developing device to develop electrostatic latent images on the photoconductor drum 21, 14 represents a primary-transfer bias roller to transfer toner images from the photoconductor drum 21 onto the intermediate transfer belt 17, 25 represents a cleaning device to clean the surface of the respective photoconductor drum 21, and 30 represents a fixing device to fix the toner image on the sheet P.

Additionally, Additionally, developer supply devices 800 are disposed above the process cartridges 20Y, 20C, 20M, and 20BK. The developer supply devices 800 respectively include developer containers 28 (shown in FIG. 2) containing yellow, cyan, magenta, and black developers supplied to the developing devices 23 and developer conveyance devices 80. In the present embodiment, two-component developer including toner and carrier is used. It is to be noted that, although reference character G represents developer, T represents toner, and C represents carrier in FIG. 2, these reference characters are omitted in the descriptions below.

Operations of the image forming apparatus 1 shown in FIG. 1 to form multicolor images are described below. It is to be noted that FIG. 2 is also referred to when image forming process performed by the process cartridges 20 are described.

The document reading unit 4 reads image data of the original set on the exposure glass 5 optically. More specifically, the document reading unit 4 scans the image on the original on the exposure glass 5 with light emitted from an illumination lamp. The light reflected from the surface of the original is imaged on a color sensor via mirrors and lenses. The multicolor image data of the original is decomposed into red, green, and blue (RGB), read by the color sensor, and converted into electrical image signals. Further, an image processor performs image processing (e.g., color conversion, color calibration, and spatial frequency adjustment) according to the image signals, and thus image data of yellow, magenta, cyan, and black are obtained.

Then, the yellow, magenta, cyan, and black image data is transmitted to the writing unit 2 (i.e., an exposure device). The writing unit 2 directs laser beams L (shown in FIG. 2) to surfaces of the respective photoconductor drums 21 according to image data of respective colors.

Figure 2:
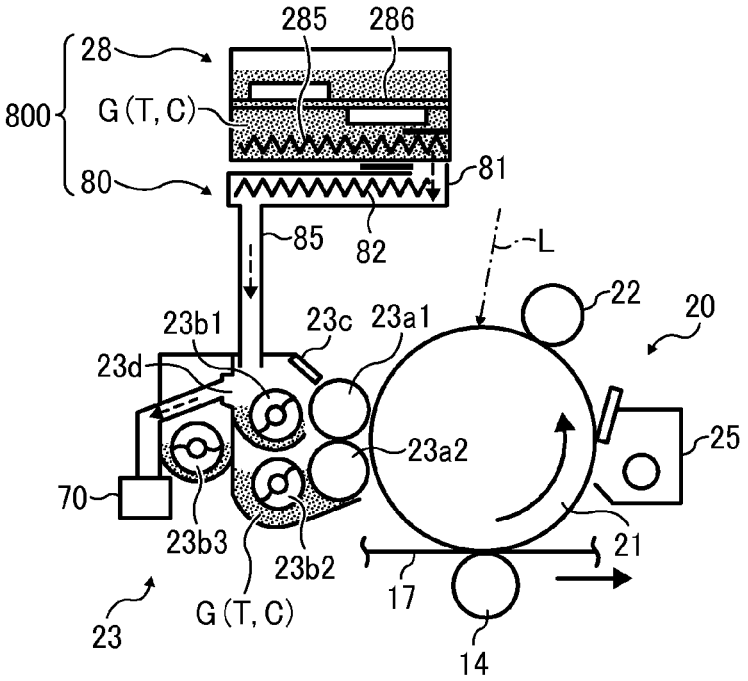
FIG. 2 is a schematic view of a portion adjacent to an image forming unit and a developer supply device according to an embodiment.

Meanwhile, the four photoconductor drums 21 rotate counterclockwise in FIGS. 1 and 2. Initially, the surface of the photoconductor drum 21 is charged by the charging device 22 (e.g., a charging roller) uniformly at a position facing the charging device 22 (charging process). Thus, the surface of the photoconductor drum 21 is charged to a predetermined electrical potential. When the surfaces of the photoconductor drums 21 reach positions to receive the respective laser beams L, the writing unit 2 directs the laser beams L according to the respective color image data, emitted from the light sources, to the respective photoconductor drums 21.

The four laser beams L pass through different optical paths for yellow, magenta, cyan, and black.

The laser beam L corresponding to the yellow component is directed to the photoconductor drum 21 in the process cartridge 20Y, which is the first from the left in FIG. 1 among the four process cartridges 20. A polygon mirror that rotates at high velocity deflects the laser beam L for yellow in a direction of a rotation axis of the photoconductor drum 21Y (main scanning direction) so that the laser beam L scans the surface of the photoconductor drum 21Y. Thus, an electrostatic latent image for yellow is formed on the photoconductor drum 21 charged by the charging device 22.

Similarly, the laser beam L corresponding to the magenta component is directed to the photoconductor drum 21 in the process cartridge 20M that is the second from the left in FIG. 1, thus forming an electrostatic latent image for magenta thereon. The laser beam L corresponding to the cyan component is directed to the third photoconductor drum 21 from the left in FIG. 1, thus forming an electrostatic latent image for cyan thereon. The laser beam L corresponding to the black component is directed to the fourth photoconductor drum 21 from the left in FIG. 1, thus forming an electrostatic latent image for black thereon.

Then, each photoconductor drum 21 reaches a position facing the developing device 23, and the developing device 23 supplies toner of the corresponding color to the photoconductor drum 21. Thus, the latent images on the respective photoconductor drums 21 are developed into different single-color toner images in a development process.

Subsequently, the surface of the photoconductor drum 21 reaches a position facing the intermediate transfer belt 17, serving as the image bearer as well as an intermediate transfer member. The primary-transfer rollers 14 are disposed at the positions where the respective photoconductor drums 21 face the intermediate transfer belt 17 and in contact with an inner circumferential surface of the intermediate transfer belt 17. At these positions, the toner images formed on the respective photoconductor drums 21 are sequentially transferred and superimposed one on another on the intermediate transfer belt 17, forming a multicolor toner image thereon, in a primary transfer process.

After the primary-transfer process, the surface of each photoconductor drum 21 reaches a position facing the cleaning device 25, where the cleaning device 25 collects toner remaining on the photoconductor drum 21 in a cleaning process.

Additionally, the surface of each photoconductor drum 21 passes through a discharge device 24 and thus a sequence of image forming processes performed on each photoconductor drum 21 is completed.

Meanwhile, the surface of the intermediate transfer belt 17 carrying the superimposed toner image moves clockwise in FIG. 1 and reaches the position facing the secondary-transfer bias roller 18. The secondary-transfer bias roller 18 transfers the multicolor toner image from the intermediate transfer belt 17 onto the sheet P (secondary-transfer process).

Further, the surface of the intermediate transfer belt 17 reaches a position facing a belt cleaning unit. The belt cleaning unit collects untransferred toner remaining on the intermediate transfer belt 17, and thus a sequence of transfer processes performed on the intermediate transfer belt 17 is completed.

The sheet P is transported from one of the sheet feeding trays 7 via the registration rollers 9, and the like, to the secondary-transfer nip between the intermediate transfer belt 17 and the secondary-transfer bias roller 18.

More specifically, a sheet feeding roller 8 sends out the sheet P from the sheet feeding tray 7, and the sheet P is then guided by a sheet guide to the registration rollers 9. The registration rollers 9 forward the sheet P to the secondary-transfer nip, timed to coincide with the arrival of the multicolor toner image on the intermediate transfer belt 17.

Then, the sheet P carrying the multicolor image is transported to the fixing device 30. The fixing device 30 includes a fixing roller and a pressure roller pressing against each other. A heat source such as a heater is provided inside the fixing roller, and, in a nip therebetween, the multicolor image is fused and fixed on the sheet P (fixing process). It is to be noted that, the fixing device 30 has a known configuration. In particular, heating types usable in the fixing device 30 include electromagnetic induction heating and heating employing a resistor in addition to heating employing a heater.

After the fixing process, paper ejection rollers discharge the sheet P as an output image outside the image forming apparatus 1. Thus, a sequence of image forming processes is completed.

The process cartridge 20 (the image forming unit), the developer container 28, and the developer conveyance device 80 are described below.

It is to be noted that the process cartridges 20Y, 20C, 20M, and 20BK, the developer containers 28, and the developer conveyance devices 80 are similar in configuration among different colors, and thus the subscripts Y, C, M, and BK are omitted in FIG. 2 and descriptions below for simplicity.

Figure 3:
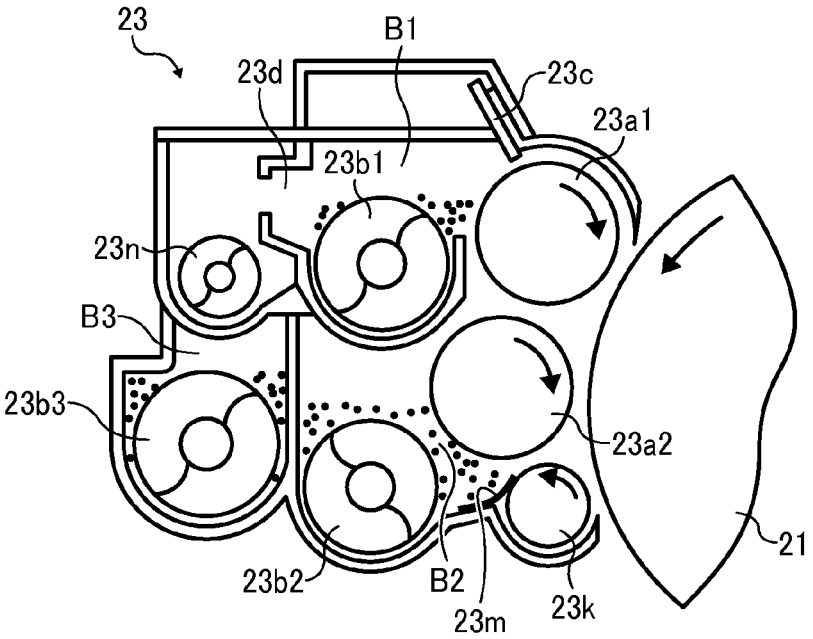
FIG. 3 is an enlarged view of a developing device according to an embodiment.

FIG. 2 is a schematic view of the process cartridge 20, the developer container 28, and the developer conveyance device 80 of the image forming apparatus 1. FIG. 3 is an enlarged view of the developing device 23 in the process cartridge 20.

As shown in FIG. 2, each process cartridge 20 includes the photoconductor drum 21, the charging device 22, the developing device 23, and the cleaning device 25, which are united together into a modular unit. The process cartridge 20 employs a development type called premix developing, in which supply and discharge of carrier is performed.

The photoconductor drum 21 in the present embodiment is a negatively-charged organic photoconductor and is rotated counterclockwise in FIG. 2 by a driving unit.

The charging device 22 is an elastic charging roller including a cored bar and an elastic layer overlying the cored bar. In one embodiment, the elastic layer is made of foamed urethane adjusted to have a moderate resistivity with conductive particles such as carbon black, a sulfuration agent, a foaming agent, or the like. The material of the elastic layer of moderate resistivity include, but not limited to, rubber such as urethane, ethylene-propylenediene (EPDM), acrylonitrile butadiene rubber (NBR), silicone rubber, and isoprene rubber to which a conductive material such as carbon black or a metal oxide is added to adjust the resistivity. Alternatively, foamed rubber including these materials may be used. Although the charging roller is used in the present embodiment, alternatively, a wire charger employing a corona discharge is used in another embodiment.

The cleaning device 25 includes a cleaning brush or a cleaning blade that slidingly contacts the surface of the photoconductor drum 21 and removes toner adhering to the photoconductor drum 21 mechanically.

The developing device 23 includes first and second developing rollers 23*a*1 and 23*a*2 disposed close to the photoconductor drum 21. In portions where the first and second developing rollers 23*a*1 and 23*a*2 face the photoconductor drum 21, a magnetic brush contacts the photoconductor drum 21, which is referred to as a development range or a development nip. The developing device 23 contains two-component developer including toner and carrier (one or more additives are also included). The developing device 23 develops the latent image on the photoconductor drum 21 with developer into a toner image.

In the developing device 23 employing premix developing, fresh developer (toner and carrier) is supplied from the developer container 28 through the developer conveyance device 80, and degraded developer (i.e., carrier mainly) is discharged to a developer reservoir 70 outside the developing device 23.

Referring to FIG. 2, the developer container 28 contains developer (toner and carrier) supplied to the developing device 23. The developer container 28 supplies fresh toner and fresh carrier to the developing device 23. Specifically, in one embodiment, according to the ratio of toner in developer (i.e., toner density) detected by a magnetic sensor provided to the developing device 23, a conveying screw 82 of the developer conveyance device 80 is driven, thereby transporting developer from a reservoir 81 to a downward channel 85. Then, the developer falls though the downward channel 85 to the developing device 23.

It is to be noted that, in the present embodiment, the ratio by weight of carrier in developer contained in the container 28 is different among the respective colors, which is described in detail later.

A configuration and operation of the developing device 23 are described.

With reference to FIG. 3, the developing device 23 includes two developer bearers, namely, the first and second developing rollers 23*a*1 and 23*a*2; three developer conveyors, namely, conveying screws 23*b*1, 23*b*2, and 23*b*3; a doctor blade 23*c* serving as a developer regulator; a carrier collecting roller 23*k*; a scraper 23*m*; and a discharge screw 23*n*. The casing and interior of the developing device 23 together define three conveyance compartments B1, B2, and B3 (i.e., a supply compartment, a collection compartment, and a stirring compartment) through which developer is transported.

For example, each of the first and second developing rollers 23*a*1 and 23*a*2 includes a cylindrical sleeve made of a nonmagnetic material and is rotated clockwise in FIG. 3 by a driving unit. The nonmagnetic material includes, but not limited to, aluminum, brass, stainless steel, and conductive resin. Magnets secured inside the sleeves of the first and second developing rollers 23*a*1 and 23*a*2 generate magnetic fields to cause developer to stand on end on the circumferential surfaces of the sleeves. Along magnetic force lines arising from the magnets in a normal direction, the carrier in developer stands on end, in a chain shape. Toner adheres to the carrier standing on end in the chain shape, thus forming a magnetic brush. As the sleeve rotates, the magnetic brush is transported in the direction of rotation of the sleeve (clockwise in FIG. 3).

The doctor blade 23*c* is disposed upstream from the development range to adjust the amount of developer carried on the first developing roller 23*a*1.

Each of the conveying screws 23*b*1 through 23*b*3 includes a spiral blade provided to a shaft and stirs developer contained in the developing device 23 while circulating the developer in the longitudinal direction or the axial direction (hereinafter "developer conveyance direction"), perpendicular to the surface of the paper on which FIG. 3 is drawn.

Specifically, inner walls of the developing device 23 partly separate the conveyance compartment B1, in which the conveying screw 23*b*1 transports developer, the conveyance compartment B2, in which the conveying screw 23*b*2 transports developer, and the conveyance compartment B3, in which the conveying screw 23*b*3 transports developer, from each other. In the description below, the term "upstream side" and "downstream side" of each of the conveyance compartments B1, B2, and B3 are based on the direction in which developer is transported in that compartment. The downstream side of the conveyance compartment B2 communicates with the upstream side of the conveyance compartment B3 via a first communicating portion. The downstream side of the conveyance compartment B3 communicates with the upstream side of the conveyance compartment B1 via a second communicating portion. The downstream side of the conveyance compartment B1 communicates with the upstream side of the conveyance compartment B3 via a downward channel. The conveying screws 23*b*1 through 23*b*3 circulate developer in the longitudinal direction through a circulation channel thus defined.

Additionally, a pocket 23*d* (i.e., an outlet) is in the wall defining the conveyance compartment B1 to discharge developer outside the developing device 23. That is, a part of developer contained in the developing device 23 is discharged via the pocket 23*d* to the developer reservoir 70. Specifically, as the developing device 23 receives developer supplied by the developer conveyance device 80, the level (i.e., an upper face) of developer flowing to the pocket 23*d* rises. When the level of developer exceeds a threshold, excessive developer is discharged through the pocket 23*d* to the developer reservoir 70. Thus, carrier contaminated with resin base or additives of toner is automatically discharged from the developing device 23. Accordingly, degradation of image quality over time is inhibited. The developing device 23 further includes the discharge screw 23*n* (shown in FIG. 3) to discharge, horizontally or substantially horizontally, the developer discharged from the pocket 23*d*.

Additionally, as shown in FIG. 3, the carrier collecting roller 23*k* is situated beneath (and downstream in the direction of rotation of the photoconductor drum 21 from) the second developing roller 23*a*2 and faces the photoconductor drum 21. The carrier that flies from the developing device 23 can adhere to the photoconductor drum 21, and the carrier collecting roller 23*k* collects the carrier adhering to the photoconductor drum 21. The scraper 23*m* is disposed to contact the carrier collecting roller 23*k* and mechanically scrapes off carrier from the carrier collecting roller 23*k*.

Since the developing device 23 according to the present embodiment employs premix developing, apparent speed of degradation of carrier is retarded, and replacement cycle of developer is elongated.

It is to be noted that, referring to FIG. 2, the developer container 28 in the present embodiment is substantially box-shaped and includes a shutter to open and close an outlet, a conveying screw 285, and a stirrer 286 (or an agitator).

Users manually install the developer container 28 in and removed from the developer conveyance device 80 (or the image forming apparatus 1) in a horizontal or substantially horizontal direction. The outlet of the developer container 28 opens downward in the bottom of the developer container 28 to discharge developer from the developer container 28 to the reservoir 81 of the developer conveyance device 80. The shutter of the developer container 28 moves in the direction in which the developer conveyance device 80 is installed in and removed from the developer conveyance device 80 to open and close the outlet.

Next, developer (carrier and toner) usable in the present embodiment is described below.

The carrier usable in the present embodiment includes a magnetic particle, such as ferrite, magnetite, and powdered iron; and a coating (i.e., coated carrier).

The mean film thickness of carrier is from 0.05 μm to 4.00 μm in one embodiment and from 0.05 μm to 1.00 μm in another embodiment. If the mean film thickness is smaller than 0.05 μm, projections due to particle shapes are not sufficiently covered. Accordingly, it is possible that the projections are abraded and cores are exposed, resulting in decreases in resistance. Additionally, if the mean film thickness exceeds 4.00 μm, chargeability decreases as carrier increases in size. Then, the possibility of degradation in image fineness increases.

A prescription according to one embodiment includes:

Silicone resin solution (with a solid component of 15% by weight);

227 parts of SR2411 from Dow Corning Toray Co., Ltd.;

6 parts of γ-(2-aminoethyl)-aminopropyltrimethoxysilane;

160 parts of alumina particles (having a particle size of 0.3 μm and a specific resistance of 1014 Ω·cm);

900 parts of toluene; and 900 parts of butyl cellosolve.

Disperse the materials described above for 10 minutes by a homomixer to prepare a filming solution. Use fired ferrite powder (F-300 from Powdertech Co., Ltd., having an average particle diameter of 50 μm) as cores. Spray the filming solution to the surfaces of cores to attain a film thickness of 0.15 μm using a Spira coater from Okada Seiko Co., Ltd, and dry the coating. Leave the carrier thus obtained under 300° C. for two hours in an electric oven for firing. After cooling, crack bulks of powdered ferrite using a sieve having openings of 100 μm to obtain carrier.

By contrast, toner in the present embodiment is selectable from various types of known toner. A typical toner including a binder resin and a colorant is used in one embodiment. In another embodiment, toner including a release agent (so-called "oilless toner") is used. Oilless toner is usable in a fixing method that employs a fixing roller without an oil coating to prevent toner adherence. Generally, when oilless toner is used, toner components (the release agent in particular) tend to be transferred to the surface of carrier, which is referred to as "spending", and developer is degraded. Premix developing is advantageous over a typical developing type, in which only toner is supplied, in that spending is suppressed since carrier is supplied in addition to toner. Accordingly, a desired quality is maintained for a long time.

In the present embodiment, to reproduce fine multicolor images in particular, polymerization toner is used since polymerization toner has a small particle diameter and is spherical in shape. Specifically, it is advantageous that the volume average particle diameter of toner particles is within a range from 3 μm to 8 μm in attaining fine dots of 600 dpi or greater. Advantageously, the ratio of the volume average particle diameter (Dv) to the number average particle diameter (Dn) is within a range of from 1.00 to 1.40 (Dv/Dn). As the ratio (Dv/Dn) approaches 1.00, the particle diameter distribution becomes narrower. The toner having a smaller particle diameter and a narrower particle diameter distribution is advantageous in equalizing distribution of charge amount and attaining higher quality images with reduced level of background fog. Additionally, an enhanced transfer rate is achieved in electrostatic transferring.

The particle diameter distribution of toner is measured, for example, using a Coulter counter TA-II or Coulter Multisizer II from Beckman Coulter, Inc. as follows.

Initially, 0.1 ml to 5 ml of surfactant, preferably alkylbenzene sulfonate, is added as dispersant to 100 ml to 150 ml of electrolyte. The electrolyte solution used here is, for example, 1 percent NaCl solution, produced using primary sodium chloride. For example, ISOTON-II manufactured by Beckman Coulter, Inc. is available as a ready-made electrolyte solution. Then, 2 mg to 20 mg of the sample (toner) is added to the electrolyte solution. Then, the electrolyte solution in which toner is suspended (i.e., a sample dispersion liquid) is dispersed by an ultrasonic disperser for about 1 to 3 minutes. The volume and the number of the toner particles are measured by either of the above measurement instruments with an aperture of 100 μm, and the volume distribution and number distribution thereof are calculated. The weight average particle diameter (D4) and the number average particle diameter (D1) are available from the distribution thus determined. The number of channels used in the measurement is thirteen. The ranges of the channels are from 2.00 μm to less than 2.52 μm, from 2.52 μm to less than 3.17 μm, from 3.17 μm to less than 4.00 μm, from 4.00 μm to less than 5.04 μm, from 5.04 μm to less than 6.35 μm, from 6.35 μm to less than 8.00 μm, from 8.00 μm to less than 10.08 μm, from 10.08 μm to less than 12.70 μm, from 12.70 μm to less than 16.00 μm, from 16.00 μm to less than 20.20 μm, from 20.20 μm to less than 25.40 μm, from 25.40 μm to less than 32.00 μm, from 32.00 μm to less than 40.30 μm. The range to be measured is set from 2.00 μm to less than 40.30 μm.

For example, the toner having high circularity with a shape factor SF-1 of from 100 to 180 and a shape factor SF-2 of from 100 to 180 in the present embodiment.

The first shape factor SF1 shows a degree of roundness of toner particles. As expressed by formula 1 below, the maximum length MXLGN of a toner particle projected on a two-dimensional surface is squared, divided by the area AREA of the toner particle, and then multiplied by $\pi/4$.

$$SF\text{-}1=\{(MXLNG)^2/AREA\}\times 100\pi/4) \quad \text{Formula 1}$$

The toner particle is a sphere when the first shape factor SF-1 is 100. As the first shape factor SF-1 increases, the toner particle becomes more amorphous.

The second shape factor SF-2 shows a degree of irregularity of toner shape. As expressed by formula 2 below, the shape factor SF-2 is obtained by dividing the square of the perimeter PERI of the figure produced by projecting the toner particle in a two-dimensional plane, by the figural surface area, and subsequently multiplying by $100\pi/4$.

$$SF\text{-}2=\{(PERI)^2/AREA\}\times(100/4\pi) \quad \text{Formula 2}$$

When the second shape factor SF-2 is 100, the surface of the toner particle has no concavities and convexities. As the second shape factor SF-2 becomes greater, the concavities and convexities thereon become more noticeable. For example, the shape factors are measured by taking a picture of the toner particle with a scanning electron microscope S-800 from Hitachi, Ltd., and analyzing 100 particles with an image analyzer LUSEX 3 from Nireco Corporation to calculate the shape factors. When toner particle are close to spheres in shape, toner particles contact each other as well as the photoconductors 21 in a point contact manner. Consequently, adsorption between the toner particles decreases, thus increasing the flowability. Moreover, adsorption between the toner particles and the photoconductors 21 decreases, thus increasing the transfer rate. When either the shape factor SF-1 or SF-2 is too large, the transfer rate deteriorates.

The toner used in the present embodiment is obtained by cross-linking reaction, elongation reaction, or both of a toner constituent liquid in an aqueous solvent. The toner constituent liquid is prepared by dispersing polyester prepolymer including a functional group having at least a nitrogen atom, a polyester, a colorant, and a release agent in an organic solvent.

A description is now given of toner constituents and a method for manufacturing toner.

(Polyester)

The polyester is prepared by a polycondensation reaction between a polyalcohol compound and a polycarboxylic acid compound. Specific examples of the polyalcohol compound (PO) include a diol (DIO) and a polyol having 3 or more valances (TO). The DIO alone, and a mixture of the DIO and a smaller amount of the TO are preferably used as the PO. Specific examples of the diol (DIO) include alkylene glycols (e.g., ethylene glycol, 1,2-propylene glycol, 1,3-propylene glycol, 1,4-butanediol, and 1,6-hexanediol), alkylene ether glycols (e.g., diethylene glycol, triethylene glycol, dipropyrene glycol, polyethylene glycol, polypropylene glycol, and polytetramethylene ether glycol), alicyclic diols (e.g., 1,4-cyclohexane dimethanol, and hydrogenated bisphenol A), bisphenols (e.g., bisphenol A, bisphenol F, and bisphenol S), alkylene oxide adducts of the above-described alicyclic diols (e.g., ethylene oxide, propylene oxide, and butylene oxide), and alkylene oxide adducts of the above-described bisphenols (e.g., ethylene oxide, propylene oxide, and butylene oxide). Among the above-described examples, alkylene glycols having 2 to 12 carbon atoms and alkylene oxide adducts of bisphenols are preferably used. More preferably, the alkylene glycols having 2 to 12 carbon atoms and the alkylene oxide adducts of bisphenols are used together. Specific examples of the polyol having 3 or more valances (TO) include aliphatic polyols having 3 to 8 or more valances (e.g., glycerin, trimethylolethane, trimethylol propane, pentaerythritol, and sorbitol), phenols having 3 or more valances (e.g., trisphenol PA, phenol novolac, and cresol novolac), and alkylene oxide adducts of polyphenols having 3 or more valances.

Specific examples of the polycarboxylic acids (PC) include dicarboxylic acids (DIC) and polycarboxylic acids having 3 or more valances (TC). The DIC alone, and a mixture of the DIC and a smaller amount of the TC are preferably used as the PC. Specific examples of the dicarboxylic acids (DIC) include alkylene dicarboxylic acids (e.g., succinic acid, adipic acid, and sebacic acid), alkenylene dicarboxylic acids (e.g., maleic acid and fumaric acid), and aromatic dicarboxylic acids (e.g., phthalic acid, isophthalic acid, terephthalic acid, and naphthalene dicarboxylic acid). Among the above-described examples, alkenylene dicarboxylic acids having 4 to 20 carbon atoms and aromatic dicarboxylic acids having 8 to 20 carbon atoms are preferably used. Specific examples of the polycarboxylic acids having 3 or more valances (TC) include aromatic polycarboxylic acids having 9 to 20 carbon atoms (e.g., trimellitic acid and pyromellitic acid). The polycarboxylic acid (PC) may be reacted with the polyol (PO) using acid anhydrides or lower alkyl esters (e.g., methyl ester, ethyl ester, and isopropyl ester) of the above-described materials.

A ratio of the polyol (PO) and the polycarboxylic acid (PC) is normally set in a range between 2/1 and 1/1, preferably between 1.5/1 and 1/1, and more preferably between 1.3/1 and 1.02/1 as an equivalent ratio [OH]/[COOH] between a hydroxyl group [OH] and a carboxyl group [COOH]. The polycondensation reaction between the polyol (PO) and the polycarboxylic acid (PC) is carried out by heating the PO and the PC to from 150° C. to 280° C. in the presence of a known catalyst for esterification such as tetrabutoxy titanate and dibutyltin oxide and removing produced water under a reduced pressure as necessary to obtain a polyester having hydroxyl groups. The polyester preferably has a hydroxyl value not less than 5, and an acid value of from 1 to 30, and preferably from 5 to 20. When the polyester has the acid value within the range, the resultant toner tends to be negatively charged to have good affinity with a recording paper, and low-temperature fixability of the toner on the recording paper improves. However, when the acid value is too large, the resultant toner is not stably charged and the stability becomes worse by environmental variations.

The polyester preferably has a weight-average molecular weight of from 10,000 to 400,000, and more preferably from 20,000 to 200,000. When the weight-average molecular weight is smaller than 10,000, offset resistance of the resultant toner deteriorates. By contrast, when the weight-average molecular weight exceeds 400,000, lower-temperature fixability thereof deteriorates. The polyester preferably includes a urea-modified polyester as well as an unmodified polyester obtained by the above-described polycondensation reaction. The urea-modified polyester is prepared by reacting a polyisocyanate compound (PIC) with a carboxyl group or a hydroxyl group at the end of the polyester obtained by the above-described polycondensation reaction to form a polyester prepolymer (A) having an isocyanate group, and reacting amine with the polyester prepolymer (A) to crosslink or elongate (or crosslink and elongate) a molecular chain thereof.

Specific examples of the polyisocyanate compound (PIC) include aliphatic polyisocyanates (e.g., tetramethylene diisocyanate, hexamethylene diisocyanate, and 2,6-diisocyanate methylcaproate), alicyclic polyisocyanates (e.g., isophorone diisocyanate and cyclohexyl methane diisocyanate), aromatic diisocyanates (e.g., tolylene diisocyanate and diphenylmethane diisocyanate), aromatic aliphatic diisocyanates (e.g., α,α,α',α'-tetramethyl xylylene diisocyanate; isocyanurates; and materials blocked against the polyisocyanate with phenol derivatives, oxime, caprolactam or the like. The above-described materials can be used in combination.

The PIC is mixed with the polyester such that an equivalent ratio [NCO]/[OH] between an isocyanate group [NCO] in the PIC and a hydroxyl group [OH] in the polyester is typically in a range from 5/1 to 1/1, preferably from 4/1 to 1.2/1, and more preferably from 2.5/1 to 1.5/1. When [NCO]/[OH] is too large, for example, greater than 5, low-temperature fixability of the resultant toner deteriorates. When [NCO]/[OH] is too small, for example, less than 1, a urea content in ester of the modified polyester decreases and hot offset resistance of the resultant toner deteriorates.

The polyester prepolymer (A) typically includes a polyisocyanate group of from 0.5 to 40% by weight, preferably from 1 to 30% by weight, and more preferably from 2 to 20% by weight. When the content is too small, hot offset resistance of the resultant toner deteriorates, and in addition, the heat resistance and lower-temperature fixability of the toner also deteriorate. By contrast, when the content is too large, lower-temperature fixability of the resultant toner deteriorates. The number of the isocyanate groups included in a molecule of the polyester prepolymer (A) is at least 1, preferably from 1.5 to 3 on average, and more preferably from 1.8 to 2.5 on average. When the number of the isocyanate group is too small per 1 molecule, the molecular weight of the urea-modified polyester decreases and hot offset resistance of the resultant toner deteriorates.

Specific examples of amines (B) reacted with the polyester prepolymer (A) include diamines (B1), multivalent amine compounds (B2) having 3 or more amino groups, amino alcohols (B3), amino mercaptans (B4), amino acids (B5), and blocked amines (B6) in which the amines (B1 to B5) described above are blocked.

Specific examples of the diamines (B1) include aromatic diamines (e.g., phenylene diamine, diethyltoluene diamine, and 4,4"-diaminodiphenyl methane), alicyclic diamines (e.g., 4,4"-diamino-3,3"-dimethyldicyclohexylmethane, diamine cyclohexane, and isophoronediamine), and aliphatic diamines (e.g., ethylene diamine, tetramethylene diamine, and hexamethylene diamine). Specific examples of the polyamines (B2) having three or more amino groups include diethylene triamine and triethylene tetramine Specific examples of the amino alcohols (B3) include ethanol amine and hydroxyethyl aniline. Specific examples of the amino mercaptan (B4) include aminoethyl mercaptan and aminopropyl mercaptan. Specific examples of the amino acids (B5) include amino propionic acid and amino caproic acid. Specific examples of the blocked amines (B6) include ketimine compounds prepared by reacting one of the amines B1 to B5 described above with a ketone such as acetone, methyl ethyl ketone and methyl isobutyl ketone; and oxazoline compounds. Among the above-described amines (B), diamines (B1) and a mixture of the B1 and a smaller amount of B2 are preferably used.

A mixing ratio [NCO]/[NHx] of the content of isocyanate groups in the prepolymer (A) to that of amino groups in the amine (B) is typically from 1/2 to 2/1, preferably from 1.5/1 to 1/1.5, and more preferably from 1.2/1 to 1/1.2. When the mixing ratio is too large or small, molecular weight of the urea-modified polyester decreases, resulting in deterioration of hot offset resistance of the toner.

The urea-modified polyester may include a urethane bonding as well as a urea bonding. The molar ratio (urea/urethane) of the urea bonding to the urethane bonding is typically from 100/0 to 10/90, preferably from 80/20 to 20/80, and more preferably from 60/40 to 30/70. When the content of urea bonding is too small, hot offset resistance of the resultant toner deteriorates.

The urea-modified polyester is prepared by a method such as a one-shot method. The PO and the PC are heated to from 150° C. to 280° C. in the presence of a known esterification catalyst such as tetrabutoxy titanate and dibutyltin oxide, and removing produced water while optionally depressurizing to prepare polyester having a hydroxyl group. Next, the polyisocyanate (PIC) is reacted with the polyester at from 40° C. to 140° C. to form a polyester prepolymer (A) having an isocyanate group. Further, the amines (B) are reacted with the polyester prepolymer (A) at from 0° C. to 140° C. to form a urea-modified polyester. When the polyisocyanate (PIC), and the polyester prepolymer (A) and the amines (B) are reacted, a solvent may optionally be used. Specific examples of the solvents include inactive solvents with the PIC such as aromatic solvents (e.g., toluene and xylene), ketones (e.g., acetone, methyl ethyl ketone and methyl isobutyl ketone), esters (e.g., ethyl acetate), amides (e.g., dimethylformamide and dimethylacetamide), and ethers (e.g., tetrahydrofuran).

A reaction terminator may optionally be used in the cross-linking, the elongation reaction, or both between the polyester prepolymer (A) and the amines (B) to control a molecular weight of the resultant urea-modified polyester. Specific examples of the reaction terminators include monoamines (e.g., diethylamine, dibutylamine, butylamine and laurylamine), and their blocked compounds (e.g., ketimine compounds).

The weight-average molecular weight of the urea-modified polyester is not less than 10,000, preferably from 20,000 to 10,000,000, and more preferably from 30,000 to 1,000,000. When the weight-average molecular weight is too small, hot offset resistance of the resultant toner deteriorates. The number-average molecular weight of the urea-modified polyester is not particularly limited when the above-described unmodified polyester resin is used in combination. Specifically, the weight-average molecular weight of the urea-modified polyester resins has priority over the number-average molecular weight thereof. However, when the urea-modified polyester is used alone, the number-average molecular weight is from 2,000 to 15,000, preferably from 2,000 to 10,000, and more preferably from 2,000 to 8,000. When the number-average molecular weight exceeds 20,000, low temperature fixability of the resultant toner and gloss level of full-color images deteriorate.

A combination of the urea-modified polyester and the unmodified polyester improves low temperature fixability of the resultant toner and gloss level of full-color images produced thereby, and is more preferably used than using the urea-modified polyester alone. Further, the unmodified polyester may include modified polyester other than the urea-modified polyester.

It is preferable that the urea-modified polyester at least partially mixes with the unmodified polyester to improve the low temperature fixability and hot offset resistance of the resultant toner. Therefore, the urea-modified polyester preferably has a composition similar to that of the unmodified polyester.

A mixing ratio between the unmodified polyester and the urea-modified polyester is from 20/80 to 95/5, preferably from 70/30 to 95/5, more preferably from 75/25 to 95/5, and even more preferably from 80/20 to 93/7. When the content of urea-modified polyester is too small, the hot offset resistance deteriorates, and in addition, it is disadvantageous to have both high temperature preservability and low temperature fixability.

The binder resin including the unmodified polyester and urea-modified polyester preferably has a glass transition temperature (Tg) of from 45° C. to 65° C., and preferably from 45° C. to 60° C. When the glass transition temperature is too low, the high temperature preservability of the toner deteriorates. By contrast, when the glass transition temperature is too high, the low temperature fixability deteriorates.

Since the urea-modified polyester is likely to be on a surface of the parent toner, the resultant toner has better heat resistance preservability than known polyester toners even though the glass transition temperature of the urea-modified polyester is low.

(Colorant)

Specific examples of the colorants for the toner usable in the present embodiment include any known dyes and pigments such as carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN, and R), Pigment Yellow L, BENZIDINE YELLOW (G and GR), PERMANENT YELLOW (NCG), VULCAN FAST YELLOW (5G and R), Tartrazine lake, Quinoline yellow lake, ANTHRAZANE YELLOW BGL, isoindolinone yellow colcothar, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL, and F4RH), Fast Scarlet VD, VULCAN FAST RUBINE B, Brilliant Scarlet G, LITHOL RUBINE GX, Permanent Red FSR, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin lake, Rhodamine lake B, Rhodamine lake Y, Alizarin lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali blue lake, Peacock blue lake, Victoria blue lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet lake, cobalt violet, manganese violet, dioxane violet, Anthraquinone Violet, Chrome Green, zinc green, chromium oxide, viridian, emerald green, Pigment Green B, Naphthol Green B, Green Gold, Acid green lake, Malachite green lake, Phthalocyanine Green, Anthraquinone Green, titanium oxide, zinc oxide, lithopone, etc. These materials can be used alone or in combination. The toner preferably includes a colorant in an amount of from 1 to 15% by weight, and more preferably from 3 to 10% by weight.

In one embodiment, the colorant is used as a master batch combined with resin. Specific examples of the resin for use in the master batch include, but are not limited to, styrene polymers and substituted styrene polymers (e.g., polystyrenes, poly-p-chlorostyrenes, and polyvinyltoluenes), copolymers of vinyl compounds and the above-described styrene polymers or substituted styrene polymers, polymethyl methacrylates, polybutyl methacrylates, polyvinyl chlorides, polyvinyl acetates, polyethylenes, polypropylenes, polyesters, epoxy resins, epoxy polyol resins, polyurethanes, polyamides, polyvinyl butyrals, polyacrylic acids, rosins, modified rosins, terpene resins, aliphatic or alicyclic hydrocarbon resins, aromatic petroleum resins, chlorinated paraffins, paraffin waxes, etc. These resins can be used alone or in combination.

(Charge Control Agent)

The toner usable in the present embodiment may optionally include a charge control agent. Specific examples of the charge control agent include any known charge control agents such as Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, and salicylic acid derivatives, but are not limited thereto. Specific examples of commercially available charge control agents include, but are not limited to, BONTRON® N-03 (Nigrosine dyes), BONTRON® P-51 (quaternary ammonium salt), BONTRON® S-34 (metal-containing azo dye), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE® PSY VP2038 (quaternary ammonium salt), COPY BLUE® PR (triphenylmethane derivative), COPY CHARGE® NEG VP2036 and COPY CHARGE® NX VP434 (quaternary ammonium salt), which are manufactured by Hoechst AG; LR1-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc. Among the above-described examples, materials that negatively charge the toner are preferably used.

The content of charge control agent is determined depending on the species of the binder resin used, and toner manufacturing method (such as dispersion method) used, and is not particularly limited. However, the content of charge control agent is typically from 0.1 to 10 parts by weight, and preferably from 0.2 to 5 parts by weight, per 100 parts by weight of the binder resin included in toner. When the content is too high, the charge amount of toner becomes too large, and the electrostatic force of the developing roller attracting the toner increases, thereby lowering the flowability of toner and image density of toner images.

(Release Agent)

Wax for use in toner as a release agent has a low melting point of from 50° C. to 120° C. When such a wax is included in toner, the wax is dispersed in the binder resin and serves as a release agent at an interface between a fixing roller and toner particles. Accordingly, hot offset resistance can be improved without applying a release agent, such as oil, to the fixing roller. Specific examples of the release agent include natural waxes including vegetable waxes such as carnauba wax, cotton wax, Japan wax and rice wax; animal waxes such as bees wax and lanolin; mineral waxes such as ozokelite and ceresine; and petroleum waxes such as paraffin waxes, microcrystalline waxes, and petrolatum. In addition, synthesized waxes can also be used. Specific examples of the synthesized waxes include synthesized hydrocarbon waxes such as Fischer-Tropsch waxes and polyethylene waxes; and synthesized waxes such as ester waxes, ketone waxes, and ether waxes. Further, fatty acid amides such as 1,2-hydroxylstearic acid amide, stearic acid amide, and phthalic anhydride imide; and low molecular weight crystalline polymers such as acrylic homopolymer and copolymers having a long alkyl group in their side chain such as poly-n-stearyl methacrylate, poly-n-laurylmethacrylate, and n-stearyl acrylate-ethyl methacrylate copolymers can also be used.

The above-described charge control agents and release agents can be dissolved and dispersed after kneaded upon application of heat together with a master batch pigment and a binder resin, and can be added when directly dissolved or dispersed in an organic solvent.

(External Additives)

An external additive is preferably added to toner particles to improve flowability, developing property, and chargeability. The inorganic fine particles preferably have a primary particle diameter of from $5\times10^{-3}$ μm to 2 μm, and more preferably, from $5\times10^{-3}$ to 0.5 μm. In addition, the inorganic fine particles preferably has a specific surface area measured by a BET method of from 20 $m^2/g$ to 500 $m^2/g$. The content of external additive is preferably from 0.01 to 5% by weight, and more preferably from 0.01 to 2.0% by weight, based on total weight of the toner composition.

Specific examples of inorganic fine particles include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, and silicon nitride. Among the above-described examples, a combination of a hydrophobic silica and a hydrophobic titanium oxide is preferably used. In particular, the hydrophobic silica and the hydrophobic titanium oxide each having an average particle diameter of not greater than $5\times10^{-2}$ μm considerably improves an electrostatic force between the toner particles and Van der Waals force. Accordingly, the resultant toner composition has a proper charge quantity. In addition, even when toner is stirred in the development device to attain a desired amount of charge, the external additive is rarely released from the toner particles. As a result, image failure such as white spots and image omissions hardly occur. Further, the amount of residual toner after image transfer can be reduced.

When fine particles of titanium oxide are used as the external additive, the resultant toner can reliably form toner images having a proper image density even when environmental conditions are changed. However, the charge rising properties of the resultant toner tend to deteriorate. Therefore, an additive amount of the titanium oxide fine particles is preferably smaller than that of silica fine particles. The amount in total of fine particles of hydrophobic silica and hydrophobic titanium oxide added is preferably from 0.3 to 1.5% by weight based on weight of the toner particles to reliably form higher-quality images without degrading charge rising properties even when images are repeatedly formed.

A method for manufacturing the toner is described in detail below, but is not limited thereto.

(Toner Manufacturing Method)

(1) The colorant, the unmodified polyester, the polyester prepolymer having an isocyanate group, and the release agent are dispersed in an organic solvent to obtain toner constituent liquid. From the viewpoint of easy removal after formation of parent toner particles, it is preferable that the organic solvent be volatile and have a boiling point of not greater than 100° C. Specific examples of the organic solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methylethylketone, and methyl isobutyl ketone. The above-described materials can be used alone or in combination. In particular, aromatic solvent such as toluene and xylene, and halogenated hydrocarbon such as methylene chloride, 1,2-dichloroethane, chloroform, and carbon tetrachloride are preferably used. The toner constituent liquid preferably includes the organic solvent in an amount of from 0 to 300 parts by weight, more preferably from 0 to 100 parts by weight, and even more preferably from 25 to 70 parts by weight based on 100 parts by weight of the polyester prepolymer.

(2) The toner constituent liquid is emulsified in an aqueous medium under the presence of a surfactant and a particulate resin. The aqueous medium may include water alone or a mixture of water and an organic solvent. Specific examples of the organic solvent include alcohols such as methanol, isopropanol, and ethylene glycol; dimethylformamide; tetrahydrofuran; cellosolves such as methyl cellosolve; and lower ketones such as acetone and methyl ethyl ketone. The toner constituent liquid includes the aqueous medium in an amount of from 50 to 2,000 parts by weight, and preferably from 100 to 1,000 parts by weight based on 100 parts by weight of the toner constituent liquid. When the amount of the aqueous medium is too small, the toner constituent liquid is not well dispersed and toner particles having a predetermined particle diameter cannot be formed. By contrast, when the amount of the aqueous medium is too large, production costs increase.

A dispersant such as a surfactant or an organic particulate resin is optionally included in the aqueous medium to improve the dispersion therein. Specific examples of the surfactants include anionic surfactants such as alkylbenzene sulfonic acid salts, α-olefin sulfonic acid salts, and phosphoric acid salts; cationic surfactants such as amine salts (e.g., alkyl amine salts, aminoalcohol fatty acid derivatives, polyamine fatty acid derivatives, and imidazoline) and quaternary ammonium salts (e.g., alkyltrimethyl ammonium salts, dialkyldimethyl ammonium salts, alkyldimethyl benzyl ammonium salts, pyridinium salts, alkyl isoquinolinium salts, and benzethonium chloride); nonionic surfactants such as fatty acid amide derivatives and polyhydric alcohol derivatives; and ampholytic surfactants such as alanine, dodecyldi(aminoethyl)glycin, di(octylaminoethyle)glycin, and N-alkyl-N,N-dimethylammonium betaine.

Surfactants having a fluoroalkyl group can achieve an effect in a small amount. Specific examples of anionic surfactants having a fluoroalkyl group include fluoroalkyl carboxylic acids having from 2 to 10 carbon atoms and their metal salts, disodium perfluorooctanesulfonylglutamate, sodium 3-[ω-fluoroalkyl(C6-C11)oxy]-1-alkyl(C3-C4) sulfonate, sodium-[ω-fluoroalkanoyl(C6-C8)-N-ethylamino]-1-propane sulfonate, fluoroalkyl(C11-C20) carboxylic acids and their metal salts, perfluoroalkylcarboxylic acids (C7-C13) and their metal salts, perfluoroalkyl(C4-C12) sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl(C6-C10)-N-ethylsulfonylglycin, and monoperfluoroalkyl(C6-C16) ethylphosphates.

Specific examples of commercially available surfactants include SURFLON® S-111, SURFLON® S-112, and SURFLON® S-113 manufactured by AGC Seimi Chemical Co., Ltd.; FRORARD FC-93, FC-95, FC-98, and FC-129 manufactured by Sumitomo 3M Ltd.; UNIDYNE DS-101 and DS-102 manufactured by Daikin Industries, Ltd.; MEGAFACE F-110, F-120, F-113, F-191, F-812, and F-833 manufactured by DIC Corporation; EFTOP EF-102, EF-103, EF-104, EF-105, EF-112, EF-123A, EF-123B, EF-306A, EF-501, EF-201, and EF-204 manufactured by JEMCO Inc.; and FUTARGENT F-100 and F-150 manufactured by Neos Co., Ltd.

Specific examples of cationic surfactants include primary and secondary aliphatic amines or secondary amino acid having a fluoroalkyl group, aliphatic quaternary ammonium salts such as perfluoroalkyl(C6-C10)sulfoneamidepropyltrimethylammonium salts, benzalkonium salts, benzetonium chloride, pyridinium salts, and imidazolinium salts. Specific examples of commercially available products thereof include SURFLON® S-121 manufactured by AGC Seimi Chemical Co., Ltd.; FRORARD FC-135 manufactured by Sumitomo 3M Ltd.; UNIDYNE DS-202 manufactured by Daikin Industries, Ltd.; MEGAFACE F-150 and F-824 manufactured by DIC Corporation; EFTOP EF-132 manufactured by JEMCO Inc.; and FUTARGENT F-300 manufactured by Neos Co., Ltd.

The resin particles are added to stabilize parent toner particles formed in the aqueous medium. Therefore, the resin particles are preferably added so as to have a coverage of from 10% to 90% over a surface of the parent toner particles. Specific examples of the resin particles include polymethylmethacrylate particles having a particle diameter of 1 μm and 3 μm, polystyrene particles having a particle diameter of 0.5 μm and 2 μm, and poly(styrene-acrylonitrile) particles having a particle diameter of 1 μm. Specific examples of commercially available products thereof include PB-200H manufactured by Kao Corporation, SGP manufactured by Soken Chemical & Engineering Co., Ltd., Technopolymer SB manufactured by Sekisui Plastics Co., Ltd., SGP-3G manufactured by Soken Chemical & Engineering Co., Ltd., and Micropearl manufactured by Sekisui Chemical Co., Ltd.

In addition, inorganic dispersants such as tricalcium phosphate, calcium carbonate, titanium oxide, colloidal silica, and hydroxy apatite can also be used.

To stably disperse toner constituents in water, a polymeric protection colloid may be used in combination with the above-described resin particles and an inorganic dispersant. Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid, and maleic anhydride), (meth) acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, glycerinmonomethacrylic acid esters, N-methylolacrylamide, and N-methylolmethacrylamide), vinyl alcohol and its ethers (e.g., vinyl methyl ether, vinyl ethyl ether, and vinyl propyl ether), esters of vinyl alcohol with a compound having a carboxyl group (e.g., vinyl acetate, vinyl propionate, and vinyl butyrate), acrylic amides (e.g., acrylamide, methacrylamide, and diacetoneacrylamide) and their methylol compounds, acid chlorides (e.g., acrylic acid chloride and methacrylic acid chloride), nitrogen-containing compounds (e.g., vinyl pyridine, vinyl pyrrolidone, vinyl imidazole, and ethylene imine), and homopolymer or copolymer having heterocycles of the nigtroge-containnig compounds. In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters), and cellulose compounds (e.g., methyl cellulose, hydroxyethyl cellulose, and hydroxypropyl cellulose) can also be used as the polymeric protective colloid.

The dispersion method is not particularly limited, and well-known methods such as low speed shearing methods, high-speed shearing methods, friction methods, high-pressure jet methods, and ultrasonic methods can be used. Among the above-described methods, the high-speed shearing methods are preferably used because particles having a particle diameter of from 2 to 20 μm can be easily prepared. When a high-speed shearing type dispersion machine is used, the rotation speed is not particularly limited, but the rotation speed is typically from 1,000 to 30,000 rpm, and preferably from 5,000 to 20,000 rpm. The dispersion time is not particularly limited, but is typically from 0.1 to 5 minutes for a batch method. The temperature in the dispersion process is typically from 0° C. to 150° C. (under pressure), and preferably from 40° C. to 98° C.

(3) While the emulsified liquid is prepared, amines (B) are added thereto to react with the polyester prepolymer (A) having an isocyanate group.

This reaction is accompanied by cross-linking, elongation, or both of a molecular chain. The reaction time depends on reactivity of an isocyanate structure of the polyester prepolymer (A) and amines (B), but is typically from 10 minutes to 40 hours, and preferably from 2 to 24 hours. The reaction temperature is typically from 0° C. to 150° C., and preferably from 40° C. to 98° C. In addition, a known catalyst such as dibutyltinlaurate and dioctyltinlaurate can be used as needed.

(4) After completion of the reaction, the organic solvent is removed from the emulsified dispersion (a reactant), and subsequently, the resulting material is washed and dried to obtain a parent toner particle.

The prepared emulsified dispersion is gradually heated while stirred in a laminar flow, and an organic solvent is removed from the dispersion after stirred strongly when the dispersion has a specific temperature to form a parent toner particle having the shape of a spindle. When an acid such as calcium phosphate or a material soluble in alkaline is used as a dispersant, the calcium phosphate is dissolved with an acid such as a hydrochloric acid, and washed with water to remove the calcium phosphate from the parent toner particle. Besides the above-described method, the organic solvent can also be removed by an enzymatic hydrolysis.

(5) A charge control agent is provided to the parent toner particle, and fine particles of an inorganic material such as silica and titanium oxide are added thereto to obtain toner. Well-known methods using a mixer or the like are used to provide the charge control agent and to add the inorganic fine particles.

Accordingly, toner having a smaller particle diameter and a sharper particle diameter distribution can be easily obtained. Further, the strong stirring in the process of removing the organic solvent can control the toner to have a shape between a spherical shape and a spindle shape, and a surface morphology between a smooth surface and a rough surface.

Next, the configuration and operation of the image forming apparatus according to the first embodiment are described in further detail below.

As described with reference to FIGS. 1 to 3, the image forming apparatus 1 according to the present embodiment includes the multiple developing devices 23 that contain two-component developer (including toner and carrier) and develop latent images on the photoconductor drums 21 into toner images; the multiple developer supply devices 800 (the developer containers 28 and the developer conveyance devices 80) to supply developer to the respective developing devices 23; and the fixing device 30 to fix the toner image on the sheet P.

Each of the multiple developing devices 23 employs premix developing and capable of discharge developer (partly or entirely) contained therein. In particular, the image forming apparatus 1 includes one developing device 23 to form black images and further includes three developing devices 23 to form different color images (yellow, magenta, and cyan images).

Figure 4:
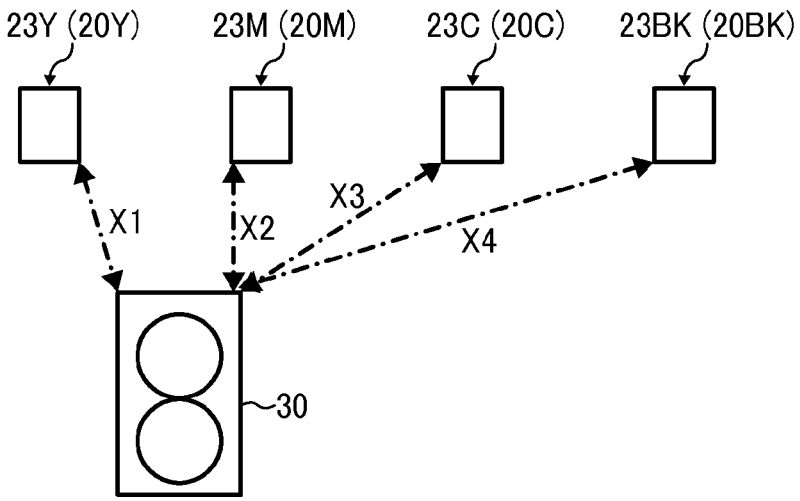
FIG. 4 is a schematic view for understanding of relative positions of a fixing device and multiple developing devices according to an embodiment.

In FIG. 4, reference characters X1, X2, X3, and X4 respectively represent shortest distances to an outline of the fixing device 30 from outlines of the developing devices 23Y, 23M, 23C, and 23BK of the process cartridges 20Y, 20M, 20C, and 20BK (hereinafter simply "distances X1, X2, X3, and X4"), which are different from each other.

In the present embodiment, referring to FIGS. 1 and 4, among the multiple developing devices 23, the developing device 23 (23M in FIG. 4) at a shortest distance (the distance X2 in FIG. 4) from the fixing device 30 is referred to as a first developing device 23, and among the multiple developer supply devices 800 (shown in FIG. 2), each of which includes the developer containers 28 and the developer conveyance devices 80, the developer supply device 800 to supply developer (magenta developer in FIG. 4) to the first developing device 23 (23M in FIG. 4) is referred to as a first developer supply device 800. In the present embodiment, the percentage by weight of carrier in developer supplied from the first developer supply device 800 to the first developing device 23 is greater than that in developer supplied from any of the rest of the multiple developer supply devices 800.

Specifically, in FIG. 4, the distance X2 to the outline of the fixing device 30 from the outline of the developing device 23M (the first developing device 23) is shorter than any of the distance X1 to the outline of the fixing device 30 from the outline of the developing device 23Y, the distance X3 to the outline of the fixing device 30 from the outline of the developing device 23C, and the distance X4 to the outline of the fixing device 30 from the outline of the developing device 23BK (X2<X1, X3, or X4).

In other words, the developer contained in the developer container 28 and supplied to the developing device 23M (the first developing device 23) closest to the fixing device 30, which is a heat source, is greater in percentage by weight of carrier than the developer supplied to any of the rest of the multiple developing devices 23.

Specifically, in the present embodiment, the developer supplied to the developing device 23M has a carrier percentage of about 25% by weight, the developer supplied to the developing device 23Y has a carrier percentage of about 13% by weight, the developer supplied to the developing device 23C has a carrier percentage of about 10% by weight, and the developer supplied to the developing device 23BK has a carrier percentage of about 16% by weight.

Since the developing device 23M (the first developing device 23) is closest to the fixing device 30, there is a possibility that the developer contained therein becomes hotter than that contained in any other developing device 23, resulting in the occurrence of spending. Therefore, the developer supplied to the developing device 23M is greater in percentage by weight of carrier to accelerate replacement of developer, and thus developer that is spent and degraded is inhibited from remaining in the developing device 23M. Accordingly, the occurrence of image failure and toner scattering caused by spending is suppressed.

In other words, in the image forming apparatus 1 according to the present embodiment, the developer supplied to the developing device 23 that is heated most among the multiple developing devices 23 is greatest in percentage by weight of carrier. In the arrangement shown in FIG. 4, the developing device 23M closest to the fixing device 30 is heated most.

More specifically, with the elapse of time and heat from the fixing device 30, toner components such as the resin base or the release agent tend to adhere to the surface of carrier, thus degrading the chargeability or capability of carrier to charge toner. When the charge of toner is insufficiently, transfer performance becomes insufficient, resulting in image failure or toner scattering.

For example, the degree of degradation of carrier (spent carrier) is evaluated based on changes in chargeability of carrier (ordinate in FIG. 5) relative to the number of sheets printed (abscissa in FIG. 5), which is substantially proportional to the operation time of the developing device 23.

Figure 5:
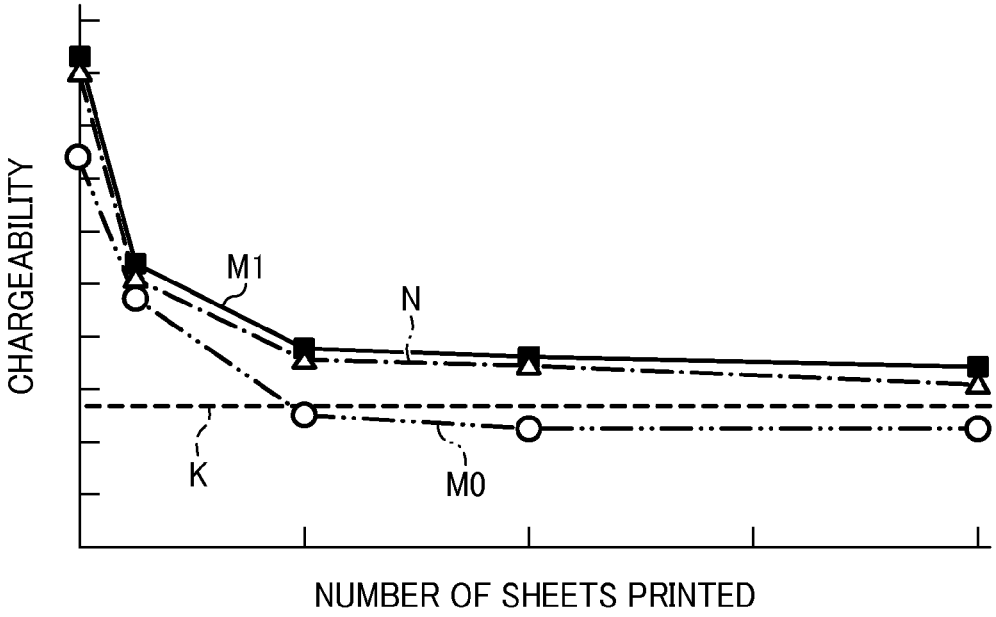
FIG. 5 is a graph of changes over time in chargeability of carrier experimentally obtained.

An experiment was performed for the above-described evaluation. Results thereof are shown in FIG. 5. In FIG. 5, a graph M1 plotted with solid squares represents changes over time in chargeability of carrier in the developing device 23M (containing magenta developer including 25% by weight of carrier) according to the present embodiment. A graph M0 plotted with circles represents changes over time in chargeability of carrier in a comparative developing device (containing magenta developer including 10% by weight of carrier). A graph N plotted with triangles represents changes over time in chargeability of carrier in the developing device 23C (containing cyan developer including 10% by weight of carrier) according to the present embodiment. Additionally, broken lines K in FIG. 5 represent a threshold of chargeability of carrier. When the chargeability of carrier decreases below the threshold K, the amount of charge of toner decreases to a degree at which transfer failure (resulting in image failure) and toner scattering are induced.

In the experiment, temperature inside each of the multiple developing devices 23 in the image forming apparatus 1 was measured with a thermocouple disposed at the doctor blade 23*c*. According to the measurement, the temperature of the developing device 23M closest to the fixing device 30 was highest, and the temperature of the developing device 23 lowered as the distance (X1 through X4) from the fixing device 30 increased.

According to the results shown in FIG. 5, increasing the percentage by weight of carrier in developer supplied to the hotter developing device 23M is effective in alleviating the degradation speed of carrier to that of carrier in the developing device 23C that is relatively cool.

Additionally, in one embodiment, the percentage of carrier in developer supplied from each of the multiple developer supply devices 800 (the developer containers 28 and the developer conveyance devices 80) is within a range from 3% to 30% by weight.

That is, the percentage of carrier in developer supplied to the developing device 23M close to the fixing device 30 is greatest, but not greater than 30% by weight in one embodiment. Although the developer container 28 and the developer reservoir 70 are bulky when the percentage by weight of carrier is too large, such an inconvenience is inhibited with this configuration.

Additionally, the percentage by weight of carrier in developer supplied to the developing device 23C is smallest, but not smaller than 3% by weight in one embodiment. Although effects of premix developing are reduced when the percentage by weight of carrier is too small, such an inconvenience are inhibited with this setting.

Additionally, as described above, in the image forming apparatus 1 according to the present embodiment, the developers supplied from the respective developer supply devices 800 are different from each other in percentage by weight of carrier.

This setting is advantageous in that the amount of carrier supplied to the developing device 23 is set individually according to the amount of effect of heat from the fixing device 30, thereby retarding the degradation speed of carrier, without unnecessarily increasing the amount of carrier to a flat amount.

Additionally, in one embodiment, among the multiple different color developers (other than black developer) supplied from the developer supply devices 800, the percentage by weight of carrier increases in the order reverse to the order of distances X1 through X3 from the fixing device 30.

Specifically, among the three developing devices 23Y, 23M, and 23C shown in FIG. 4, the developing device 23M is closest (at the shortest distance X2) to the fixing device 30, the developing device 23Y is second closest (at the distance X1) to the fixing device 30, and the developing device 23C is farthest (at the distance X3) from the fixing device 30 (X2<X1<X3). In this arrangement, the weight percentage of carrier is greatest in the developer supplied to the developing device 23M (25%) positioned at the distance X2, second greatest in the developer supplied to the developing device 23Y (13%) positioned at the distance X1, and smallest in the developer supplied to the developing device 23C (10%) at the distance X3.

Since the three developing devices 23Y, 23M, and 23C are similar in frequency of use, the degradation speed of carrier is equally retarded by setting the amount of carrier supplied thereto individually according to the amount of effect of heat from the fixing device 30 (i.e., the distances X1 through X3).

By contrast, the developing device 23BK is typically higher in frequency of use than the developing devices 23 for other colors. Accordingly, in the present embodiment, the amount of carrier in developer supplied thereto is set to an increased value (16% by weight) compared to the distance X4 from the fixing device 30, which is relatively long and reduces the effect of heat.

With this setting, the degradation speed of carrier is equally retarded in the four developing devices 23 including those for color developers. This setting is advantageous in reducing downtime caused by replacement of developer in the entire image forming apparatus 1 and inhibiting increases in running cost.

Additionally, in one embodiment, carbon black is used for black toner, and the chargeability of carrier in black developer is higher than that in any of yellow, magenta, and cyan developers. The chargeability of carrier to charge toner is adjusted by the selection of charge control agents described above and the adjustment of additives.

Thus, spending of carrier to charge black toner, which is less easily charged, is retarded by enhancing the chargeability of carrier in black developer from that in any of other color developers. With this setting, the degradation speed of carrier is equally retarded in the four developing devices 23 including those for color developers. This setting is advantageous in reducing downtime caused by replacement of developer in the entire image forming apparatus 1 and inhibiting increases in running cost.

As described above, in the present embodiment, the developer supplied to the first developing device 23 closest to the fixing device 30, out of the multiple developing devices 23, is greater in percentage by weight of carrier than the developer supplied to the rest of the multiple developing devices 23. With this setting, in the configuration including the multiple developing devices 23 employing premix developing, the occurrence of spending of carrier in developer contained in the first developing device 23 closest to the fixing device 30 is inhibited.

It is to be noted that the descriptions above concern the image forming apparatus 1 in which two-component developer is contained in the developer container 28 and supplied therefrom to the developing device 23. Alternatively, aspects of this specification can adapt to image forming apparatuses in which toner discharged from a toner container is mixed with carrier discharged from a carrier container to have a desired percentage of carrier (i.e., mixture ratio) therein and then supplied to the developing device.

Additionally, although the substantially box-shaped developer containers 28 are remarkably installed in the image forming apparatus 1 in the description above, the configurations of the developer containers 28 are not limited thereto. For example, cylindrical developer bottles are used in another embodiment, and developer bags are used in yet another embodiment.

Additionally, although the descriptions above concern the image forming apparatus 1 in which the developer conveyance device 80 includes the reservoir 81 extending substantially horizontally and the downward channel 85, embodiments according to this specification are not limited thereto. For example, an image forming apparatus according to another embodiment includes a developer supply device that is directly connected to the developing device 23 without the downward channel 85, and an image forming apparatus according to yet another embodiment includes a developer supply device employing an air pump to transport developer together with air.

In such configurations, effects similar to those described above are also attained.

Additionally, in the description above, the photoconductor drum 21 serving as the image bearer, the charging device 22, the developing device 23, and the cleaning device 25 are grouped into the process cartridge 20. However, in another embodiment, the photoconductor drum 21, the charging device 22, the developing device 23, and the cleaning device 25 are independently installed in and removed from the image forming apparatus 1, and, in yet another embodiment, at least two of these components are united into the process cartridge 20 and the rest are independently installed in and removed from the image forming apparatus 1. In such configurations, effects similar to those described above are also attained.

It is to be noted that the term "process cartridge" used in this specification means an integrated unit including an image bearer and at least one of a charging device, a developing device, and a cleaning device housed in a common unit casing that is removably installed in the image forming apparatus.

Further, although, in the description above, the developing device 23M serves as the first developing device 23 closest to the fixing device 30 and other developing devices 23 are positioned as shown in FIG. 4, the relative positions of the multiple developing devices 23 and the fixing device 30 are not limited thereto. Effects similar to those described above are attained by setting the percentage by weight of carrier according to the relative positions of the multiple developing devices 23 and the fixing device 30 so that the developer supplied to the first developing device 23 closest to the fixing device 30 is greater in percentage by weight of carrier than the developer supplied to any of other developing devices 23.

Numerous additional modifications and variations are possible in light of the above teachings. It is therefore to be understood that within the scope of the appended claims, the present disclosure may be practiced otherwise than as specifically described herein. Such variations are not to be regarded as a departure from the scope of the present disclosure and appended claims, and all such modifications are intended to be included within the scope of the present disclosure and appended claims. The number, position, and shape of the components of the image forming apparatus described above are not limited to those described above.

What is claimed is:

1. An image forming apparatus comprising:

at least one image bearer to bear a latent image;

multiple developing devices to develop the latent image with developers including toner and carrier into a toner image at a transfer belt, wherein each developing device is fixed at a different position along the transfer belt;

multiple developer supply devices to supply the developers to the multiple developing devices, respectively; and a fixing device to fix the toner image on a sheet of recording media, wherein, when one of the multiple developing devices at a shortest distance from an outline of the fixing device is referred to as a first developing device, the developer supplied to the first developing device by a corresponding one of the multiple developer supply devices has a greater in percentage by weight of carrier than any of the developers supplied to the rest of the multiple developing devices.

2. The image forming apparatus according to claim 1, wherein each of the developers supplied by the multiple developing devices to the multiple developing device is within a range from 3% to 30% in percentage by weight of carrier.

3. The image forming apparatus according to claim 1, wherein the developers supplied by the multiple developer supply devices to the multiple developing devices, respectively, are different from each other in percentage by weight of carrier.

4. The image forming apparatus according to claim 1, wherein the multiple developing devices include multiple color developing devices to develop the latent image with color developers other than black developer, the multiple color developing devices positioned at different distances from the outline of the fixing device, the multiple developer supply devices includes multiple color developer supply devices to supply the color developers to the respective color developing devices, and regarding the percentage by weight of carrier therein, the color developers supplied to the multiple color developing devices are in an order reverse to an order of the distances from the outline of the fixing device to the respective color developing devices.

5. The image forming apparatus according to claim 1, wherein the multiple developing devices include a black developing device to develop the latent image with black developer including carbon black, and the black developer is higher in toner chargeability of carrier than any of the developers used by rest of the multiple color developing devices.

6. The image forming apparatus according to claim 1, wherein each of the multiple developing devices comprises an outlet to discharge at least a part of the developer contained therein.

7. The image forming apparatus according to claim 1, wherein:

the distance from an outline of the fixing device to the first developing device is measured through intervening components of the image forming apparatus.

8. The image forming apparatus according to claim 1, wherein:

the first developing device is exposed to more heat from the fixing device than any other developing devices within the image forming apparatus.

9. The image forming apparatus according to claim 1, wherein:

the temperatures of the multiple developing devices reduce as distance from the fixing device increases.

10. The image forming apparatus according to claim 1, wherein:

each of the multiple developing devices are arranged in a direction in which the sheet is transported, the multiple developing devices includes an upstream developing device and a downstream developing device disposed at both ends in the direction in which the sheet is transported, and the fixing device is disposed below a space between the upstream developing device and the downstream developing device.

11. The image forming apparatus according to claim 10, wherein:

the first developing device is disposed between the upstream developing device and the downstream developing device.

12. The image forming apparatus according to claim 1, wherein the multiple developing devices include black developing device to develop the latent image with black developers, the black developing devices at longest distances from the outline of the fixing device.

13. The image forming apparatus according to claim 4, wherein the multiple developing devices include a black developing device to develop the latent image with black developer, the black developing devices disposed at a longest distance from the outline of the fixing device, and the black developing device is greater in percentage by weight of carrier than out of the multiple color developing devices, a farthest color developing device from the outline of the fixing device.

14. An image forming apparatus comprising:

at least one image bearer to bear a latent image;

multiple developing devices to develop the latent image with developers including toner and carrier into a toner image at a transfer belt, wherein each developing device is fixed at a different position along the transfer belt;

multiple developer supply devices to supply the developers to the multiple developing devices, respectively; and a fixing device to fix the toner image on a sheet of recording media, wherein, when one of the multiple developing devices at a shortest distance from an outline of the fixing device is referred to as a first developing device, a first developer supplied to the first developing device is greater in percentage by weight of carrier than any other developer supplied to the rest of the multiple developing devices.

15. The image forming apparatus of claim 1, wherein:

the first developing device receives a greater amount of heat generated by the fixing device that any other developing device.

* * * * *